US008354149B2

(12) United States Patent
Simpson et al.

(10) Patent No.: US 8,354,149 B2
(45) Date of Patent: Jan. 15, 2013

(54) TRANSPARENT INK-JET RECORDING FILMS, COMPOSITIONS, AND METHODS

(75) Inventors: Sharon M. Simpson, Lake Elmo, MN (US); David G. Baird, Woodbury, MN (US); Heidy M. Vosberg, Lake Elmo, MN (US)

(73) Assignee: Carestream Health Inc., Rochester, NY (US)

( * ) Notice: Subject to any disclaimer, the term of this patent is extended or adjusted under 35 U.S.C. 154(b) by 0 days.

(21) Appl. No.: 13/281,886

(22) Filed: Oct. 26, 2011

(65) Prior Publication Data

US 2012/0107529 A1 May 3, 2012

Related U.S. Application Data

(60) Provisional application No. 61/408,688, filed on Nov. 1, 2010.

(51) Int. Cl.
*B41M 5/00* (2006.01)

(52) U.S. Cl. ..... 428/32.13; 428/32.22; 428/32.25; 428/32.26; 428/32.28; 428/32.34

(58) Field of Classification Search ..... 428/32.13, 428/32.22, 32.25, 32.26, 32.28, 32.34
See application file for complete search history.

(56) References Cited

U.S. PATENT DOCUMENTS

| | | | | |
|---|---|---|---|---|
| 4,365,423 | A | 12/1982 | Arter et al. | |
| 5,023,129 | A | 6/1991 | Morganti et al. | |
| 5,683,793 | A | 11/1997 | Malhotra et al. | |
| 5,795,708 | A | 8/1998 | Boutet | |
| 6,013,354 | A * | 1/2000 | Tomizawa et al. | 428/206 |
| 6,630,283 | B1 | 10/2003 | Simpson et al. | |
| 7,621,614 | B2 | 11/2009 | Endo | |
| 2003/0064208 | A1 * | 4/2003 | Yamada et al. | 428/195 |
| 2008/0020152 | A1 | 1/2008 | Watanabe et al. | |
| 2008/0057232 | A1 * | 3/2008 | Leon et al. | 428/32.24 |

FOREIGN PATENT DOCUMENTS

| | | | |
|---|---|---|---|
| EP | 1 245 400 | A1 | 10/2002 |
| EP | 1 386 751 | A2 | 2/2004 |
| JP | 11-321072 | | 11/1999 |
| JP | 2002-172854 | | 6/2002 |

OTHER PUBLICATIONS

PCT International Search Report, International application No. PCT/US2011/057967, dated Mar. 26, 2012, 2 pages.

Commonly Assigned U.S. Appl. No. 13/176,788, "Transparent Ink-Jet Recording Film," by Simpson et al., filed Jul. 6, 2011.

Commonly Assigned U.S. Appl. No. 13/208,379, "Transparent Ink-Jet Recording Films, Compositions, and Methods," by Simpson et al., filed Aug. 12, 2011.

*Research Disclosure*, No. 308119, Dec. 1989, pp. 1007-1008, 46 pages, (available from Research Disclosure, 145 Main St., Ossining, NY, 10562).

* cited by examiner

*Primary Examiner* — Betelhem Shewareged
(74) *Attorney, Agent, or Firm* — Reed L Christiansen

(57) ABSTRACT

The compositions and methods of the present application can provide transparent ink-jet recording films that may be used by printers relying on optical detection of fed media. Such films can be useful for medical image reproduction.

7 Claims, No Drawings

TRANSPARENT INK-JET RECORDING FILMS, COMPOSITIONS, AND METHODS

CROSS REFERENCE TO RELATED APPLICATIONS

This application claims the benefit of U.S. Provisional Application No. 61/408,688, filed Nov. 1, 2010, entitled TRANSPARENT INK-JET RECORDING FILMS, COMPOSITIONS, AND METHODS, which is hereby incorporated by reference in its entirety.

SUMMARY

Ink-jet printers relying on optical detection of media may have difficulty detecting transparent ink-jet recording films that fed to them. The compositions and methods of the present application can provide transparent ink-jet recording films that are detectable by such printers. Such films can be useful for medical image reproduction.

At least one embodiment provides a transparent ink-jet recording film comprising a transparent substrate comprising a polyester, where the substrate comprises at least a first surface and a second surface, at least one under-layer disposed on the first surface, at least one image-receiving layer disposed on the at least one under-layer, where the at least one image-receiving layer comprises at least one inorganic particle and at least one water soluble or water dispersible polymer comprising at least one hydroxyl group, and at least one back-coat layer disposed on the second surface, where the at least one back-coat layer comprises gelatin, wherein at least one of the at least one of the at least one under-layer, at least one image-receiving layer, or at least one back-coat layer further comprises at least one reflective comprising at least one of rice starch, zirconium dioxide, zinc oxide, or titanium dioxide.

In at least some embodiments, the at least one reflective particle comprises rice starch.

In at least some embodiments, the at least one reflective particle comprises zirconium dioxide.

In at least some embodiments, the at least one reflective particle comprises titanium dioxide. In some such cases, the at least one reflective particle may comprise zirconium dioxide and titanium dioxide. In other cases, the at least one reflective particle may comprise zinc oxide and titanium dioxide. In still other cases, the at least one reflective particle may comprise zirconium dioxide, zinc oxide, and titanium dioxide.

In at least some embodiments, the at least one back-coat layer comprises the at least one reflective particle.

In at least some embodiments, the at least one inorganic particle comprises bohemite alumina and the at least one water soluble or water dispersible polymer comprise poly (vinyl alcohol). In some cases, the image-receiving layer may further comprise nitric acid.

At least some embodiments provide transparent ink-jet recording films exhibiting haze values less than about 41%, as measured in accord with ASTM D 1003 by conventional means using a HAZE-GARD PLUS Hazemeter, available from BYK-Gardner (Columbia, Md.). In such films, the at least one back-coat layer may, for example, comprise the at least one reflective particle. Such at least one reflective particles may, in some cases, comprise rice starch, Or such at least one reflective particles may, in some other cases, comprise zirconium dioxide. Or, in still other cases, such at least one reflective particles may comprise both rice starch and zirconium dioxide.

These embodiments and other variations and modifications may be better understood from the detailed description, exemplary embodiments, examples, and claims that follow. Any embodiments provided are given only by way of illustrative example. Other desirable objectives and advantages inherently achieved may occur or become apparent to those skilled in the art. The invention is defined by the appended claims.

DETAILED DESCRIPTION

All publications, patents, and patent documents referred to in this document are incorporated by reference herein in their entirety, as though individually incorporated by reference.

U.S. Provisional Application No. 61/408,688, filed Nov. 1, 2010, entitled TRANSPARENT INK-JET RECORDING FILMS, COMPOSITIONS, AND METHODS, is hereby incorporated by reference in its entirety.

Transparent Ink-Jet Recording Film Image Densities

An ink-jet recording film may comprise at least one image-receiving layer, which receives ink from an ink-jet printer during printing, and a substrate or support, which may be opaque or transparent. A transparent support may be used in transparent films, where the printed image may be viewed using light transmitted through the film.

Some medical imaging applications may require that the recording film be able to represent a wide range of image densities, from a large maximum $D_{max}$ to a small minimum $D_{min}$. This image density range may be expressed in terms of the recording film's dynamic range, which is the ratio of $D_{max}$ to $D_{min}$. A larger dynamic range generally enables higher fidelity reproduction of medical imaging data on the ink-jet recording film.

For transparent ink-jet recording films, the maximum image density will generally be limited by printing ink drying rates. Achievement of high image densities using transparent recording films may require application of large quantities of ink. The amount of ink that may be applied will, in general, be limited by the time required for the ink to dry after being applied to the film.

Because of this practical upper limit on $D_{max}$, achievement of high dynamic ranges will generally rely on achieving smaller minimum image densities. This may be expressed in terms of a transparent recording film's high transmittance at a particular wavelength of visible light, its low percent haze as measured at a particular angle with respect to the film surface, or in terms of its small minimum optical density $D_{min}$.

Optical Media Detection in Ink-Jet Printers

Some ink-jet printers, such as, for example, the EPSON® Model 4900, have been designed to be able to reproduce "borderless" images of photographs and the like. In order to reduce or eliminate the borders surrounding printed images, such printers may rely on optical sensors to be able to determine when the leading edge of a media sheet is near the print head or heads. Because these printers may be marketed for use with highly reflective opaque media sheets, such as paper, the printer control algorithms may rely on receiving a strong signal from a beam of radiation reflected from the opaque media sheet in order to recognize its leading edge.

An example of such an optical detection system is provided in U.S. Pat. No. 7,621,614 to Endo, which is hereby incorporated by reference in its entirety. Endo describes a sensor, moving with the print head, which detects the leading edge of a media sheet through use of obliquely reflected infrared light. As the leading edge of the media sheet passes through a region illuminated by an infrared light emitting diode (LED), the amount of infrared light reflected increases, and a voltage generated at an infrared-sensitive phototransistor changes. When the voltage passes through a detection threshold level, a printer controller recognizes the presence of the leading edge of the media sheet and commences printing an image. Endo indicates that the detection threshold voltage may be set for the case where the leading edge of a sheet of paper occupies 50% of the region illuminated by the infrared LED.

The use of such an optical detection system with transparent media can be problematic. Because of the low reflectivity of the media, the voltage generated at the infrared-sensitive phototransistor may not be sufficient to pass through the detection threshold level, and the transparent media sheet may not be detected at all. In other cases, the transparent media sheet may be detected, but not until well after its leading edge has travelled past the point where the leading edge of a sheet of paper might be detected. This may cause the area available for printing to be shortened, leading to incomplete printing of images onto the transparent media.

Transparent Ink-Jet Films

Transparent ink-jet recording films are known in the art. See, for example, U.S. patent application Ser. No. 13/176,788, "TRANSPARENT INK-JET RECORDING FILM," by Simpson et al., filed Jul. 6, 2011, and U.S. patent application Ser. No. 13/208,379, "TRANSPARENT INK-JET RECORDING FILMS, COMPOSITIONS, AND METHODS," by Simpson et al., filed Aug. 12, 2011, both of which are herein incorporated by reference in their entirety.

Transparent ink-jet recording films may comprise one or more transparent substrates upon which at least one under-layer may be coated. Such an under-layer may optionally be dried before being further processed. The film may further comprise one or more image-receiving layers coated upon at least one under-layer. Such an image-receiving layer is generally dried after coating. In some embodiments, the film may further comprise additional layers, such as one or more back-coat layers or overcoat layers, as will be understood by those skilled in the art.

Under-Layer Coating Mix

Under-layers may be formed by applying at least one under-layer coating mix to one or more transparent substrates. The under-layer formed may, in some cases, comprise at least about 2.9 g/m$^2$ solids on a dry basis, or at least about 3.0 g/m$^2$ solids on a dry basis, or at least about 3.5 g/m$^2$ solids on a dry basis, or at least about 4.0 g/m$^2$ solids on a dry basis, or at least about 4.2 g/m$^2$ solids on a dry basis, or at least about 5.0 g/m$^2$ solids on a dry basis, or at least about 5.8 g/m$^2$ solids on a dry basis. The under-layer coating mix may comprise gelatin. In at least some embodiments, the gelatin may be a Regular Type IV bovine gelatin. The under-layer coating mix may further comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to, for example, about 2 g/m$^2$. In at least some embodiments, the ratio of the at least one borate or borate derivative to the gelatin may be between about 20:80 and about 1:1 by weight, or the ratio may be about 0.45:1 by weight. In some embodiments, the under-layer coating mix may comprise, for example, at least about 4 wt % solids, or at least about 9.2 wt % solids. The under-layer coating mix may comprise, for example, about 15 wt % solids.

The under-layer coating mix may also comprise a thickener. Examples of suitable thickeners include, for example, anionic polymers, such as sodium polystyrene sulfonate, other salts of polystyrene sulfonate, salts of copolymers comprising styrene sulfonate repeat units, anionically modified polyvinyl alcohols, and the like.

The at least one under-layer coating mix may further comprise at least one reflective particle, such as, for example one or more of rice starch, or zirconium dioxide, zinc oxide, or titanium dioxide.

In some embodiments, the under-layer coating mix may optionally further comprise other components, such as surfactants, such as, for example, nonyl phenol, glycidyl polyether. In some embodiments, such a surfactant may be used in amount from about 0.001 to about 0.20 g/m$^2$, as measured in the under-layer. These and other optional mix components will be understood by those skilled in the art.

Image-Receiving Layer Coating Mix

Image-receiving layers may be formed by applying at least one image-receiving layer coating mix to one or more under-layer coatings. The image-receiving layer formed may, in some cases, comprise at least about 40 g/m$^2$ solids on a dry basis, or at least about 41.3 g/m$^2$ solids on a dry basis, or at least about 45 g/m$^2$ solids on a dry basis, or at least about 49 g/m$^2$ solids on a dry basis. The image-receiving coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the image-receiving layer coating mix. In some embodiments, the at least one water soluble or water dispersible polymer may be used in an amount of up to about 1.0 to about 4.5 g/m$^2$, as measured in the image-receiving layer.

The image-receiving layer coating mix may also comprise at least one inorganic particle, such as, for example, metal oxides, hydrated metal oxides, boehmite alumina, clay, calcined clay, calcium carbonate, aluminosilicates, zeolites, barium sulfate, and the like. Non-limiting examples of inorganic particles include silica, alumina, zirconia, and titania. Other non-limiting examples of inorganic particles include fumed silica, fumed alumina, and colloidal silica. In some embodiments, fumed silica or fumed alumina have primary particle sizes up to about 50 nm in diameter, with aggregates being less than about 300 nm in diameter, for example, aggregates of about 160 nm in diameter. In some embodiments, colloidal silica or boehmite alumina have particle size less than about 15 nm in diameter, such as, for example, 14 nm in diameter. More than one type of inorganic particle may optionally be included in the image-receiving coating mix.

In at least some embodiments, the ratio of inorganic particles to polymer in the at least one image-receiving layer coating mix may be, for example, between about 88:12 and about 95:5 by weight, or the ratio may be about 92:8 by weight.

Image-receiving layer coating layer mixes prepared from alumina mixes with higher solids fractions can perform well in this application. However, high solids alumina mixes can, in general, become too viscous to be processed. It has been discovered that suitable alumina mixes can be prepared at, for example, 25 wt % or 30 wt % solids, where such mixes comprise alumina, nitric acid, and water, and where such mixes comprise a pH below about 3.09, or below about 2.73, or between about 2.17 and about 2.73. During preparation, such alumina mixes may optionally be heated, for example, to 80° C.

The image-receiving coating layer mix may also comprise one or more surfactants such as, for example, nonyl phenol, glycidyl polyether. In some embodiments, such a surfactant may be used in amount of, for example, about 1.5 g/m$^2$, as measured in the image-receiving layer. In some embodiments, the image-receiving coating layer may also optionally comprise one or more acids, such as, for example, nitric acid.

The at least one image-receiving layer coating mix may further comprise at least one reflective particle, such as, for example one or more of rice starch, or zirconium dioxide, zinc oxide, or titanium dioxide.

These and components may optionally be included in the image-receiving coating layer mix, as will be understood by those skilled in the art.

Back-Coat Layer Coating Mix

Back-coat layers may be formed by applying at least one back-coat coating mix to one or more transparent substrates. In some embodiments, the at least one back-coat layer coating mix may be applied on the side of the one or more transparent substrates opposite to that which the under-layer coating mix or image receiving layer coating mix is applied.

The at least one back-coat layer coating mix may comprise gelatin. In at least some embodiments, the gelatin may be a Regular Type IV bovine gelatin.

The at least one back-coat layer coating mix may further comprise other hydrophilic colloids, such as, for example, dextran, gum arabic, zein, casein, pectin, collagen derivatives, collodion, agar-agar, arrowroot, albumin, and the like. Other examples of hydrophilic colloids are water-soluble polyvinyl compounds such as polyvinyl alcohol, polyacrylamides, polymethacrylamide, poly(N,N-dimethacrylamide), poly(N-isopropylacrylamide), poly(vinylpyrrolidone), poly (vinyl acetate), polyalkylene oxides such as polyethylene oxide, poly(6,2-ethyloxazolines), polystyrene sulfonate, polysaccharides, or cellulose derivatives such as carboxymethyl cellulose, hydroxyethyl cellulose, their sodium salts, and the like.

The at least one back-coat layer coating mix may further comprise at least one reflective particle, such as, for example one or more of rice starch, or zirconium dioxide, zinc oxide, or titanium dioxide.

The at least one back-coat layer coating mix may further comprise at least one colloidal inorganic particle, such as, for example, colloidal silicas, modified colloidal silicas, colloidal aluminas, and the like. Such colloidal inorganic particles may be, for example, from about 5 nm to about 100 nm in diameter.

The at least one back-coat layer coating mix may further comprise at least one hardening agent. In some embodiments, the at least one hardening agent may be added to the coating mix as the coating mix is being applied to the substrate, for example, by adding the at least one hardening agent upstream of an in-line mixer located in a line downstream of the back-coat coating mix tank. In some embodiments, such hardeners may include, for example, 1,2-bis(vinylsulfonylacetamido)ethane, bis(vinylsulfonyl)methane, bis(vinylsulfonylmethyl)ether, bis(vinylsulfonylethyl)ether, 1,3-bis(vinylsulfonyl)propane, 1,3-bis(vinylsulfonyl)-2-hydroxypropane, 1,1,-bis(vinylsulfonyl)ethylbenzenesulfonate sodium salt, 1,1,1-tris(vinylsulfonyl)ethane, tetrakis(vinylsulfonyl)methane, tris(acrylamido)hexahydro-s-triazine, copoly(acrolein-methacrylic acid), glycidyl ethers, acrylamides, dialdehydes, blocked dialdehydes, alpha-diketones, active esters, sulfonate esters, active halogen compounds, s-triazines, diazines, epoxides, formaldehydes, formaldehyde condensation products anhydrides, aziridines, active olefins, blocked active olefins, mixed function hardeners such as halogen-substituted aldehyde acids, vinyl sulfones containing other hardening functional groups, 2,3-dihydroxy-1,4-dioxane, potassium chrome alum, polymeric hardeners such as polymeric aldehydes, polymeric vinylsulfones, polymeric blocked vinyl sulfones and polymeric active halogens. In some embodiments, the at least one hardening agent may comprise a vinylsulfonyl compound, such as, for example bis(vinylsulfonyl)methane, 1,2-bis(vinylsulfonyl)ethane, 1,1-bis(vinylsulfonyl)ethane, 2,2-bis(vinylsulfonyl)propane, 1,1-bis(vinylsulfonyl)propane, 1,3-bis(vinylsulfonyl)propane, 1,4-bis(vinylsulfonyl) butane, 1,5-bis(vinylsulfonyl)pentane, 1,6-bis(vinylsulfonyl) hexane, and the like.

In some embodiments, the at least one back-coat layer coating mix may optionally further comprise at least one surfactant, such as, for example, one or more anionic surfactants, one or more cationic surfactants, one or more fluorosurfactants, one or more nonionic surfactants, and the like. These and other optional mix components will be understood by those skilled in the art.

Transparent Substrate

Transparent substrates may be flexible, transparent films made from polymeric materials, such as, for example, polyethylene terephthalate, polyethylene naphthalate, cellulose acetate, other cellulose esters, polyvinyl acetal, polyolefins, polycarbonates, polystyrenes, and the like. In some embodiments, polymeric materials exhibiting good dimensional stability may be used, such as, for example, polyethylene terephthalate, polyethylene naphthalate, other polyesters, or polycarbonates.

Other examples of transparent substrates are transparent, multilayer polymeric supports, such as those described in U.S. Pat. No. 6,630,283 to Simpson, et al., which is hereby incorporated by reference in its entirety. Still other examples of transparent supports are those comprising dichroic mirror layers, such as those described in U.S. Pat. No. 5,795,708 to Boutet, which is hereby incorporated by reference in its entirety.

Transparent substrates may optionally contain colorants, pigments, dyes, and the like, to provide various background colors and tones for the image. For example, a blue tinting dye is commonly used in some medical imaging applications. These and other components may optionally be included in the transparent substrate, as will be understood by those skilled in the art.

In some embodiments, the transparent substrate may be provided as a continuous or semi-continuous web, which travels past the various coating, drying, and cutting stations in a continuous or semi-continuous process.

Coating

The at least one under-layer and at least one image-receiving layer may be coated from mixes onto the transparent substrate. The various mixes may use the same or different solvents, such as, for example, water or organic solvents.

Layers may be coated one at a time, or two or more layers may be coated simultaneously. For example, simultaneously with application of an under-layer coating mix to the support, an image-receiving layer may be applied to the wet under-layer using such methods as, for example, slide coating.

The at least one back-coat layer may be coated from at least one mix onto the opposite side of the transparent substrate from the side on which the at least one under-layer coating mix and the at least one image-receiving layer coating mix are coated. In at least some embodiments, two or more mixes may be combined and mixed using an in-line mixer to form the coating that is applied to the substrate. The at least one back-coat layer may be applied simultaneously with the application of either of the at least one under-layer or at least one image receiving layer, or may be coated independently of the application of the other layers.

Layers may be coated using any suitable methods, including, for example, dip-coating, wound-wire rod coating, doctor blade coating, air knife coating, gravure roll coating, reverse-roll coating, slide coating, bead coating, extrusion coating, curtain coating, and the like. Examples of some coating methods are described in, for example, *Research Disclosure, No.* 308119, December 1989, pp. 1007-08, (available from Research Disclosure, 145 Main St., Ossining, N.Y., 10562, http://www.researchdisclosure.com).

Drying

Coated layers, such as, for example, under-layers or image-receiving layers, may be dried using a variety of known methods. Examples of some drying methods are described in, for example, *Research Disclosure*, No. 308119, December 1989, pp. 1007-08, (available from Research Disclosure, 145 Main St., Ossining, N.Y., 10562, http://www.researchdisclosure-.com). In some embodiments, coating layers may be dried as they travel past one or more perforated plates through which a gas, such as, for example, air or nitrogen, passes. Such an impingement air dryer is described in U.S. Pat. No. 4,365,423 to Arter et al., which is incorporated by reference in its entirety. The perforated plates in such a dryer may comprise perforations, such as, for example, holes, slots, nozzles, and the like. The flow rate of gas through the perforated plates may be indicated by the differential gas pressure across the plates. The ability of the gas to remove water may be limited by its dew point, while its ability to remove organic solvents may be limited by the amount of such solvents in the gas, as will be understood by those skilled in the art.

Exemplary Embodiments

U.S. Provisional Application No. 61/408,688, filed Nov. 1, 2010, entitled TRANPARENT INK-JET RECORDING FILMS, COMPOSITIONS, AND METHODS, which is hereby incorporated by reference in its entirety, disclosed the following five exemplary embodiments:

A. A transparent ink-jet recording film comprising:

a transparent substrate comprising a polyester, said substrate comprising at least a first surface and a second surface;

at least one under-layer disposed on said first surface;

at least one image-receiving layer disposed on said at least one under-layer, said at least one image-receiving layer comprising at least one water soluble or water dispersible polymer and at least one inorganic particle, said at least one water soluble or water dispersible polymer comprising at least one hydroxyl group; and at least one back-coat layer disposed on said second surface, said at least one back-coat layer comprising gelatin, wherein at least one of said at least one under-layer, said at least one image-receiving layer, or said at least one back-coat layer further comprises at least one reflective particle.

B. The transparent ink-jet coating according to embodiment A, wherein said at least one reflective particle comprises at least one of rice starch, zirconium dioxide, zinc oxide, or titanium dioxide.

C. The transparent ink-jet coating according to embodiment A, wherein said at least one reflective particle comprises zirconium dioxide and titanium dioxide.

D. The transparent ink-jet coating according to embodiment A, wherein said at least one reflective particle comprises zinc oxide and titanium dioxide.

E. The transparent ink-jet coating according to embodiment A, wherein said at least one back-coat layer comprises said at least one reflective particle.

EXAMPLES

Materials

Materials used in the examples were available from Aldrich Chemical Co., Milwaukee, unless otherwise specified.

Bis(vinysulfonyl)methane was used as an 0.5 wt % aqueous solution by dilution with deionized water.

Boehmite is an aluminum oxide hydroxide (γ-AlO(OH)).

Borax is sodium tetraborate decahydrate.

CELVOL® 540 is a poly(vinyl alcohol) that is 87-89.9% hydrolyzed, with 140,000-186,000 weight-average molecular weight. It was available from Sekisui Specialty Chemicals America, LLC, Dallas, Tex.

Colloidal silica was provided as SYLOID® C-809. It was available from W. R. Grace & Company, Columbia, Md. It was used as a 7.5% solids slurry by dilution with deionized water.

DISPERAL® HP-14 is a dispersible boehmite alumina powder with high porosity and a particle size of 14 nm. It was available from Sasol North America, Inc., Houston, Tex.

Gelatin is a Regular Type IV bovine gelatin. It was available as Catalog No. 8256786 from Eastman Gelatine Corporation, Peabody, Mass.

KATHON® LX is a microbiocide. It was available from Dow Chemical.

Rice starch was provided as a 5 wt % aqueous slurry by dilution with deionized water.

Surfactant 10G is a nominal 50 wt % aqueous solution of nonyl phenol, glycidyl polyether. It was available from Dixie Chemical Co., Houston, Tex. It was used at a ten-fold dilution in deionized water.

Ti-PURE® R-746 is a nominal 76.5 wt % aqueous slurry of rutile titanium dioxide, with 99.99 wt % of particles passing a 325 mesh screen. It was available from DuPont. It was used as a 5 wt % solids slurry by dilution with deionized water.

VERSA-TL® 502 is a sulfonated polystyrene (1,000,000 molecular weight). It was available from AkzoNobel.

Zinc oxide is a nominal 50 wt % aqueous dispersion of zinc oxide nanoparticles, <100 nm particle size, <35 nm average particle size. It was used at a ten-fold dilution in deionized water.

Zirconium dioxide is a 5 wt % aqueous dispersion of zirconium(IV) oxide nanoparticles, <100 nm particle size.

Example 1

Preparation of Gelatin Under-Layer Coating Mix

A nominal 8.0 wt % under-layer coating mix was prepared at room temperature by introducing 444.5 kg of demineralized water to a mixing vessel. 33.33 kg of gelatin was added to the agitated vessel and allowed to swell. This mix was heated to 60° C. and held until the gelatin was fully dissolved. The mix was then cooled to 50° C. To this mix, 15 kg of borax (sodium tetraborate decahydrate) was added and mixed until the borax was fully dissolved. To this mix, 51.4 kg of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 11.4 kg of a 10 wt % aqueous solution of nonyl phenol, glycidyl polyether (Surfactant 10G) was then added and mixed until homogeneous. This mix was cooled to room temperature and held to allow disengagement of any gas bubbles prior to use. The ratio of borax to gelatin in the resulting under-layer coating mix was 0.45:1 by weight.

Preparation of Under-Layer Coated Webs

The under-layer coating mix was heated to 40° C. and applied continuously to room temperature polyethylene terephthalate web, which were moving at a speed of 600 ft/min. The under-layer coating mix was fed to the web through two slots at a feed rate of 11.033 kg/min/slot. The coated webs were dried continuously by moving at 800 ft/min past perforated plates through which 26-30° C. air flowed. The pressure drop across the perforated plates was in the range of 0.2 to 5 in $H_2O$. The air dew point was in the range of 0 to 12° C. The resulting dry under-layer coating weight was 3.7 g/m$^2$.

Preparation of Alumina Mix

An alumina mix was prepared at room temperature by mixing 75.4 kg of a 9.7 wt % aqueous solution of nitric acid and 764.6 kg of demineralized water. To this mix, 360 kg of alumina powder (DISPERAL® HP-14) was added over 30 min. The pH of the mix was adjusted to 2.17 by adding additional nitric acid solution. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 156.5 kg of a 10 wt % aqueous solution of poly(vinyl alcohol) (CELVOL® 540) into a mixing vessel and agitating. To this mix, 600.0 kg of the alumina mix and 14.5 kg of a 10 wt % aqueous solution of nonyl phenol, glycidyl polyether (Surfactant 10G) was added. The mix was cooled to room temperature and held for gas bubble disengagement prior to use.

Preparation of Image-Receiving Layer Coated Films

The image-coating mix was heated to 40° C. and coated onto the under-layer coated surface of a room temperature polyethylene terephthalate web, which was moving at a speed of 400 ft/min. The image-receiving layer coating mix was fed to the web through five slots at a feed rate of 7.74 kg/min/slot. The coated films were dried continuously by moving at 400 ft/min past perforated plates through which 26-35° C. air flowed. The pressure drop across the perforated plates was in the range of 0.8 to 3 in $H_2O$. The air dew point was in the range of 0 to 13° C. The resulting image-receiving layer coating weight was 43.4 g/m$^2$.

Preparation of Back-Coat Layer Coatings

Coating mixture #1-1 consisted of 96 parts by weight water, 3.4 parts by weight gelatin, 0.60 parts by weight rice starch, 0.035 parts by weight colloidal silica, 0.0080 parts by weight bis(vinylsulfonyl)methane, and 0.0067 parts by weight Surfactant 10G. Coating mixture #1-2 consisted of 96 parts by weight water, 3.5 parts by weight gelatin, 0.45 parts by weight rice starch, 0.035 parts by weight colloidal silica, 0.0080 parts by weight bis(vinylsulfonyl)methane, and 0.0067 parts by weight Surfactant 10G. Coating mixture #1-3 consisted of 96 parts by weight water, 3.2 parts by weight gelatin, 0.75 parts by weight rice starch, 0.035 parts by weight colloidal silica, 0.0080 parts by weight bis(vinylsulfonyl) methane, and 0.0067 parts by weight Surfactant 10G. Coating mixture #1-4 consisted of 96 parts by weight water, 3.3 parts by weight gelatin, 0.67 parts by weight rice starch, 0.035 parts by weight colloidal silica, 0.0080 parts by weight bis(vinylsulfonyl)methane, and 0.0067 parts by weight Surfactant 10G. Coating mixture #1-5 consisted of 96 parts by weight water, 3.1 parts by weight gelatin, 0.83 parts by weight rice starch, 0.035 parts by weight colloidal silica, 0.0080 parts by weight bis(vinylsulfonyl)methane, and 0.0067 parts by weight Surfactant 10G.

Coating mixtures #1-1, #1-2, and #1-3 were coated onto the side of the coated substrates opposite that on which the under-layer and image-receiving layers had been applied, at a dry coating weight of 1.5 g/m$^2$, using a hand-drawn wire-wound rod coater. Coating mixtures #1-4 and #1-5 were coated similarly, at a dry coating weight of 1.1 g/m$^2$, using a hand-drawn wire-wound rod coater. The coatings were dried with a hot air gun.

Evaluation of Transparent Coated Films

The coated films were fed to a three different EPSON® 4900 printers, back-coat layer sides oriented away from the print-heads, and an image was printed on each. The heights of the resulting printed images were measured and percent print lengths were calculated, based on a 100% print length of 23.8 cm. The results are shown in Table I, referenced to control samples that had no back-coat layer applied.

Example 2

Preparation of Image-Receiving Layer Coated Films

Image-layer coated films were prepared according to the procedure of Example 1.

Preparation of Back-Coat Layer Coatings

Coating mixture #2-1 consisted of 96 parts by weight water, 3.4 parts by weight gelatin, 0.60 parts by weight zirconium dioxide, 0.035 parts by weight colloidal silica, 0.0080 parts by weight bis(vinylsulfonyl)methane, and 0.0067 parts by weight Surfactant 10G. Coating mixture #2-2 consisted of 96 parts by weight water, 3.4 parts by weight gelatin, 0.60 parts by weight zirconium dioxide, 0.035 parts by weight colloidal silica, 0.0080 parts by weight bis(vinylsulfonyl) methane, and 0.0067 parts by weight Surfactant 10G. Coating mixture #2-3 consisted of 96 parts by weight water, 3.2 parts by weight gelatin, 0.75 parts by weight zirconium dioxide, 0.035 parts by weight colloidal silica, 0.0080 parts by weight bis(vinylsulfonyl)methane, and 0.0067 parts by weight Surfactant 10G. Coating mixture #2-4 consisted of 96 parts by weight water, 3.3 parts by weight gelatin, 0.67 parts by weight zirconium dioxide, 0.035 parts by weight colloidal silica, 0.0080 parts by weight bis(vinylsulfonyl)methane, and 0.0067 parts by weight Surfactant 10G. Coating mixture #2-5 consisted of 96 parts by weight water, 3.1 parts by weight gelatin, 0.83 parts by weight zirconium dioxide, 0.035 parts by weight colloidal silica, 0.0080 parts by weight bis(vinylsulfonyl)methane, and 0.0067 parts by weight Surfactant 10G.

Coating mixtures #2-1 and #2-3 were coated onto polyethylene terephthalate substrates at a dry coating weight of 1.5 g/m$^2$, using a hand-drawn wire-wound rod coater. Coating mixtures #2-2, #2-4, and #2-5 were coated onto polyethylene terephthalate substrates at a dry coating weight of 1.1 g/m$^2$, using a hand-drawn wire-wound rod coater. The coatings were dried with a hot air gun.

Evaluation of Transparent Coated Films

The coated films were fed to a three different EPSON® 4900 printers, back-coat coated sides oriented away from the print-heads, and an image was printed on each. The heights of the resulting printed images were measured and percent print lengths were calculated, based on a 100% print length of 23.8 cm. The results are shown in Table II, referenced to uncoated control samples.

Example 3

Preparation of Image-Receiving Layer Coated Films

Image-layer coated films were prepared according to the procedure of Example 1.

Preparation of Back-Coat Layer Coatings

Coating mixture #3-1 consisted of 96 parts by weight water, 3.6 parts by weight gelatin, 0.16 parts by weight titanium dioxide, 0.16 parts by weight zirconium dioxide, 0.035 parts by weight colloidal silica, 0.0080 parts by weight bis (vinylsulfonyl)methane, and 0.0067 parts by weight Surfactant 10G. Coating mixture #3-2 consisted of 96 parts by weight water, 3.6 parts by weight gelatin, 0.24 parts by weight titanium dioxide, 0.08 parts by weight zirconium dioxide, 0.035 parts by weight colloidal silica, 0.0080 parts by weight bis(vinylsulfonyl)methane, and 0.0067 parts by weight Surfactant 10G. Coating mixture #3-3 consisted of 96 parts by weight water, 3.6 parts by weight gelatin, 0.24 parts by weight zirconium dioxide, 0.08 parts by weight titanium dioxide, 0.035 parts by weight colloidal silica, 0.0080 parts by weight bis(vinylsulfonyl)methane, and 0.0067 parts by weight Surfactant 10G.

Coating mixtures #3-1, #3-2, and #3-3 were coated onto polyethylene terephthalate substrates at a dry coating weight of 1.1 g/m$^2$, using a hand-drawn wire-wound rod coater. The coatings were dried with a hot air gun.

Evaluation of Transparent Coated Films

The coated substrates were fed to a three different EPSON® 4900 printers, back-coat coated sides oriented away from the print-heads, and an image was printed on each. The heights of the resulting printed images were measured and percent print lengths were calculated, based on a 100% print length of 23.8 cm. The results are shown in Table III, referenced to uncoated control samples.

Example 4

Coating mixture #4-1 consisted of 96 parts by weight water, 3.6 parts by weight gelatin, 0.16 parts by weight titanium dioxide, 0.16 parts by weight zinc oxide, 0.035 parts by weight colloidal silica, 0.0080 parts by weight bis(vinylsulfonyl)methane, and 0.0067 parts by weight Surfactant 10G. Coating mixture #4-2 consisted of 96 parts by weight water, 3.6 parts by weight gelatin, 0.24 parts by weight titanium dioxide, 0.08 parts by weight zinc oxide, 0.035 parts by weight colloidal silica, 0.0080 parts by weight bis(vinylsulfonyl)methane, and 0.0067 parts by weight Surfactant 10G. Coating mixture #4-3 consisted of 96 parts by weight water, 3.6 parts by weight gelatin, 0.24 parts by weight zinc oxide, 0.08 parts by weight titanium dioxide, 0.035 parts by weight colloidal silica, 0.0080 parts by weight bis(vinylsulfonyl) methane, and 0.0067 parts by weight Surfactant 10G.

Coating mixtures #4-1, #4-2, and #4-3 were coated onto polyethylene terephthalate substrates at a dry coating weight of 1.1 g/m$^2$, using a hand-drawn wire-wound rod coater. The coatings were dried with a hot air gun.

Evaluation of Transparent Coated Films

The coated films were fed to a three different EPSON® 4900 printers, coated sides oriented away from the print-heads, and an image was printed on each. The heights of the resulting printed images were measured and percent print lengths were calculated, based on a 100% print length of 23.8 cm. The results are shown in Table IV, referenced to uncoated control samples.

Example 5

Preparation of Image-Receiving Layer Coated Films

Image-receiving layer coated films were prepared according to the procedure of Example 1.

Preparation of Back-Coat Layer Coatings

A back-coat layer coating mix was prepared consisting of 20.18 parts by weight deionized water, 7.26 parts by weight of a 15% aqueous solution of gelatin, 1.92 parts by weight titanium dioxide, 0.14 parts by weight colloidal silica, and 0.02 parts by weight of a 10% aqueous solution of Surfactant 10G. The coating mix was applied to the back side of the image-receiving layer coated films at a dry coating weight of 1.1 g/m$^2$ (Samples 5-1 to 5-4) or 1.5 g/m$^2$ (Samples 5-5 to 5-8) using a hand-drawn wire-wound rod coater. The coatings were dried with a hot air gun.

Evaluation of Transparent Coated Films

The coated films were fed to a three different EPSON® 4900 printers, back-coat coated sides oriented away from the print-heads, and an image was printed on each. The heights of the resulting printed images were measured and percent print lengths were calculated, based on a 100% print length of 23.8 cm. Haze (%) was measured in accord with ASTM D 1003 by conventional means using a HAZE-GARD PLUS Hazemeter, available from BYK-Gardner (Columbia, Md.). The results of these evaluations, along with the comparable results of samples from Examples 1-4 that achieved 100% print length, are show in Table V.

It is notable that the samples containing titanium dioxide exhibited higher haze values than those that did not. On the other hand, the samples containing titanium dioxide were able to achieve 100% print length over a broader range of conditions than those that did not.

Example 6

Preparation of Under-Layer Coating Compositions

The under-layer coating mix was prepared by mixing at room temperature 239.64 g of deionized water and 18.00 g of gelatin. The gelatin was added over the course of 15 min. After the gelatin was added, the mixture continued to be agitated for 15 min. The agitated mixture was then heated to 60° C. and agitated an additional 15 min. To this mixture was added 8.10 g of sodium tetraborate decahydrate and mixed 15 min. To this agitated mixture was added 27.2 g deionized water, 0.9 g of a sulfonated polystyrene (VERSA-TL® 502, AkzoNobel), and 0.056 g of a 4.7 wt % aqueous solution of a microbiocide (KATHON® LX, Dow). This mixture continued to be agitated for 15 min and then was cooled to 40° C. To this mixture was added 6.14 g of a 10 wt % aqueous solution of nonyl phenol, glycidyl polyether (Surfactant 10G, Dixie). After addition of the polyether solution, the mixture was agitated for 5 min and was then cooled to room temperature.

Preparation of Under-Layer Coated Substrates

To 20.0 g of under-layer coating mix was added either no zirconium oxide (Samples 6-1, 6-2, 6-3, and 6-4) or 2.0 g of a 10 wt % aqueous solution of zirconium oxide (Sample 6-5) or 4.0 g of a 10 wt % aqueous solution of zirconium oxide (Sample 6-6). The under-layer coatings were coated at 40° C. onto blue tinted polyethylene terephthalate substrates, using a coating gap of 3.0 mils. The coatings were air-dried, resulting in dry coating under-layer coating weights of 4.1 g/m$^2$. The under-layer coating compositions are summarized in Table VI.

Preparation of Alumina Mix

An alumina mix was prepared at room temperature by mixing 3.6 g of a 22 wt % aqueous solution of nitric acid and 556.4 g of deionized water. To this mix, 140 g of alumina powder (DISPERAL® HP-14) was added over 30 min. The pH of the mix was adjusted to 3.25 by adding additional nitric acid solution. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 7.13 g of a 10 wt % aqueous solution of poly(vinyl alcohol) (CELVOL® 540) and 1.00 g of deionized water into a mixing vessel and agitating.

To this mix, 41.00 g of the alumina mix and 0.66 g of a 10 wt % aqueous solution of nonyl phenol, glycidyl polyether (Surfactant 10G) was added either no zirconium oxide (Samples 6-1, 6-2, 6-5, and 6-6) or 2.0 g of a 10 wt % aqueous solution of zirconium oxide (Sample 6-3) or 4.0 g of a 10 wt % aqueous solution of zirconium oxide n (Sample 6-4). The mix was cooled to room temperature and held for gas bubble disengagement prior to use.

Preparation of Image-Receiving Layer Coated Films

The image-receiving layer coating mixes were coated onto the under-layer coated substrates, using a coating gap of 12.0 to 12.2 mils. The coated films were dried at 50° C. in a Blue-M oven, resulting in dry coating under-layer coating weights of 44.8 g/m$^2$.

Evaluation of Transparent Coated Films

The coated films were evaluated using the procedures and printer of Example 1. The results are shown in Table VI. Samples containing zirconium oxide in the under-layer and printed 100% to full length by the printer in the under-layer exhibited much higher haze than those films with zirconium dioxide in the back-coat layer as shown in Table V. Samples containing zirconium dioxide in the receptor layer, even at high coating weights of 1.9 g/m$^2$, did not print full-length images, but exhibited higher haze than those films with zirconium dioxide in the back-coat layer that did print to full length.

Example 7

Preparation of Under-Layer Coating Compositions

The under-layer coating mix was prepared by mixing at room temperature 257.75 g of deionized water and 12.60 g of gelatin. The gelatin was added over the course of 15 min. After the gelatin was added, the mixture continued to be agitated for 15 min. The agitated mixture was then heated to 60° C. and agitated an additional 15 min. To this mixture was added 5.67 g of sodium tetraborate decahydrate and mixed 15 min. To this agitated mixture was added 19.0 g deionized water, 0.63 g of a sulfonated polystyrene (VERSA-TL® 502, AkzoNobel), and 0.039 g of a 4.7 wt % aqueous solution of a microbiocide (KATHON® LX, Dow). This mixture continued to be agitated for 15 min and then was cooled to 40° C. To this mixture was added 4.30 g of a 10 wt % aqueous solution of nonyl phenol, glycidyl polyether (Surfactant 10G, Dixie). After addition of the polyether solution, the mixture was agitated for 5 min and then cooled to room temperature.

Preparation of Under-Layer Coated Substrates

To 20.0 g of under-layer coating mix was added either no rice starch (Samples 7-1 and 7-2) or 1.7 g of a 10 wt % aqueous solution of rice starch (Samples 7-3 and 7-4) or 2.30 g of a 10 wt % aqueous solution of rice starch (Samples 7-5 and 7-6) or 3.00 g of a 10 wt % aqueous solution of rice starch (Samples 7-7 and 7-8). The under-layer coatings were coated at 40° C. onto blue tinted polyethylene terephthalate substrates, using a coating gap of 4.5 to 4.8 mils. The coatings were air-dried, resulting in dry coating under-layer coating weights of 4.5 to 5.0 g/m$^2$. The under-layer coating compositions are summarized in Table VII.

Preparation of Alumina Mix

An alumina mix was prepared at room temperature by mixing 3.6 g of a 22 wt % aqueous solution of nitric acid and 556.4 g of deionized water. To this mix, 140 g of alumina powder (DISPERAL® HP-14) was added over 30 min. The pH of the mix was adjusted to 3.25 by adding additional nitric acid solution. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 7.13 g of a 10 wt % aqueous solution of poly(vinyl alcohol) (CELVOL® 540) and 1.00 g of deionized water into a mixing vessel and agitating.

To this mix, 41.00 g of the alumina mix and 0.66 g of a 10 wt % aqueous solution of nonyl phenol, glycidyl polyether (Surfactant 10G) was added. The mix was cooled to room temperature and held for gas bubble disengagement prior to use.

Preparation of Image-Receiving Layer Coated Films

The image-receiving layer coating mixes were coated onto the under-layer coated substrates, using a coating gap of 12.0 mils. The coated films were dried at 50° C. in a Blue-M oven, resulting in dry coating under-layer coating weights of 44.8 g/m$^2$.

Evaluation of Transparent Coated Films

The coated films were evaluated using the procedures and printer of Example 1. The results are shown in Table VII. Samples containing rice starch in the under-layer that printed to full length exhibited much higher haze than those films in Table V with rice starch in the back-coat layer that printed to full length.

The invention has been described in detail with reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced within.

TABLE I

| Sample ID | Rice Starch (dry basis) | Dry Coating Weight (g/sq · m) | Rice Starch (Coverage (g/sq · m) | Printer ID | Relative Humidity | Print Length |
|---|---|---|---|---|---|---|
| Control | 0.00% | 0.00 | 0.000 | A | 31% | 92.4% |
| 1-1 | 15.00% | 1.50 | 0.225 | A | 31% | 93.3% |
| 1-2 | 11.25% | 1.50 | 0.169 | A | 31% | 93.3% |
| 1-3 | 18.75% | 1.50 | 0.281 | A | 31% | 93.3% |
| 1-4 | 16.75% | 1.10 | 0.200 | A | 31% | 93.3% |
| 1-5 | 20.75% | 1.10 | 0.250 | A | 31% | 93.3% |
| 1-2 | 11.25% | 1.50 | 0.169 | B | 20% | 93.9% |
| 1-5 | 20.75% | 1.10 | 0.250 | B | 20% | 94.0% |
| Control | 0.00% | 0.00 | 0.000 | B | 20% | 94.3% |
| 1-3 | 18.75% | 1.50 | 0.281 | B | 20% | 94.3% |
| 1-4 | 16.75% | 1.10 | 0.200 | B | 20% | 94.3% |
| 1-1 | 15.00% | 1.50 | 0.225 | B | 20% | 96.4% |
| 1-3 | 18.75% | 1.50 | 0.281 | B | 84% | 98.7% |
| 1-4 | 16.75% | 1.10 | 0.200 | B | 84% | 99.6% |
| 1-1 | 15.00% | 1.50 | 0.225 | B | 84% | 100% |
| 1-2 | 11.25% | 1.50 | 0.169 | B | 84% | 100% |
| 1-5 | 20.75% | 1.10 | 0.250 | B | 84% | 100% |
| Control | 0.00% | 0.00 | 0.000 | C | 32% | 90.6% |
| 1-1 | 15.00% | 1.50 | 0.225 | C | 32% | 90.6% |
| 1-2 | 11.25% | 1.50 | 0.169 | C | 32% | 90.6% |
| 1-5 | 20.75% | 1.10 | 0.250 | C | 32% | 90.6% |
| 1-3 | 18.75% | 1.50 | 0.281 | C | 32% | 91.1% |
| 1-4 | 16.75% | 1.10 | 0.200 | C | 32% | 91.1% |

TABLE II

| Sample ID | $ZrO_2$ (dry basis) | Dry Coating Weight (g/sq · m) | $ZrO_2$ Coverage (g/sq · m) | Printer ID | Relative Humidity | Print Length |
|---|---|---|---|---|---|---|
| Control | 0.00% | 0.00 | 0.000 | A | 31% | 92.4% |
| 2-2 | 11.25% | 1.10 | 0.165 | A | 31% | 92.4% |
| 2-4 | 16.75% | 1.10 | 0.200 | A | 31% | 92.4% |
| 2-5 | 20.75% | 1.10 | 0.250 | A | 31% | 92.9% |
| 2-1 | 15.00% | 1.50 | 0.225 | A | 31% | 93.3% |
| 2-3 | 18.75% | 1.50 | 0.281 | A | 31% | 93.3% |
| 2-4 | 16.75% | 1.10 | 0.200 | B | 20% | 94.0% |
| Control | 0.00% | 0.00 | 0.000 | B | 20% | 94.3% |
| 2-2 | 11.25% | 1.10 | 0.165 | B | 20% | 94.3% |
| 2-5 | 20.75% | 1.10 | 0.250 | B | 20% | 94.3% |
| 2-3 | 18.75% | 1.50 | 0.281 | B | 20% | 96.0% |
| 2-1 | 15.00% | 1.50 | 0.225 | B | 20% | 96.0% |

TABLE II-continued

| Sample ID | $ZrO_2$ (dry basis) | Dry Coating Weight (g/sq · m) | $ZrO_2$ Coverage (g/sq · m) | Printer ID | Relative Humidity | Print Length |
|---|---|---|---|---|---|---|
| 2-4 | 16.75% | 1.10 | 0.200 | B | 84% | 95.0% |
| 2-2 | 11.25% | 1.10 | 0.165 | B | 84% | 96.0% |
| 2-1 | 15.00% | 1.50 | 0.225 | B | 84% | 96.2% |
| 2-3 | 18.75% | 1.50 | 0.281 | B | 84% | 100.0% |
| 2-5 | 20.75% | 1.10 | 0.250 | B | 84% | 100.0% |
| Control | 0.00% | 0.00 | 0.000 | C | 32% | 90.6% |
| 2-1 | 15.00% | 1.50 | 0.225 | C | 32% | 90.6% |
| 2-2 | 11.25% | 1.10 | 0.165 | C | 32% | 90.6% |
| 2-4 | 16.75% | 1.10 | 0.200 | C | 32% | 90.6% |
| 2-5 | 20.75% | 1.10 | 0.250 | C | 32% | 90.6% |
| 2-3 | 18.75% | 1.50 | 0.281 | C | 32% | 91.1% |

TABLE III

| Sample ID | $TiO_2$ + $ZrO_2$ (dry basis) | $TiO_2$ to $ZrO_2$ Ratio | Dry Coating Weight (g/sq · m) | $TiO_2$ + $ZrO_2$ Coverage (g/sq · m) | Printer ID | Relative Humidity | Print Length |
|---|---|---|---|---|---|---|---|
| Control | 0.00% | — | 0.00 | 0.000 | A | 31% | 92.4% |
| 3-3 | 8.00% | 1:3 | 1.10 | 0.088 | A | 31% | 92.4% |
| 3-1 | 8.00% | 1:1 | 1.10 | 0.088 | A | 31% | 93.3% |
| 3-2 | 8.00% | 3:1 | 1.10 | 0.088 | A | 31% | 93.7% |
| Control | 0.00% | — | 0.00 | 0.000 | B | 20% | 94.3% |
| 3-3 | 8.00% | 1:3 | 1.10 | 0.088 | B | 20% | 94.3% |
| 3-1 | 8.00% | 1:1 | 1.10 | 0.088 | B | 20% | 94.8% |
| 3-2 | 8.00% | 3:1 | 1.10 | 0.088 | B | 20% | 95.2% |
| 3-3 | 8.00% | 1:3 | 1.10 | 0.088 | B | 84% | 96.2% |
| 3-1 | 8.00% | 1:1 | 1.10 | 0.088 | B | 84% | 96.2% |
| 3-2 | 8.00% | 3:1 | 1.10 | 0.088 | B | 84% | 100.0% |
| Control | 0.00% | — | 0.00 | 0.000 | C | 32% | 90.6% |
| 3-3 | 8.00% | 1:3 | 1.10 | 0.088 | C | 32% | 90.6% |
| 3-1 | 8.00% | 1:1 | 1.10 | 0.088 | C | 32% | 90.6% |
| 3-2 | 8.00% | 3:1 | 1.10 | 0.088 | C | 32% | 91.1% |

TABLE IV

| Sample ID | $TiO_2$ + ZnO (dry basis) | $TiO_2$ to ZnO Ratio | Dry Coating Weight (g/sq · m) | $TiO_2$ + ZnO Coverage (g/sq · m) | Printer ID | Relative Humidity | Print Length |
|---|---|---|---|---|---|---|---|
| Control | 0.00% | — | 0.00 | 0.000 | A | 31% | 92.4% |
| 4-3 | 8.00% | 1:3 | 1.10 | 0.088 | A | 31% | 92.4% |
| 4-1 | 8.00% | 1:1 | 1.10 | 0.088 | A | 31% | 93.3% |
| 4-2 | 8.00% | 3:1 | 1.10 | 0.088 | A | 31% | 93.3% |
| Control | 0.00% | — | 0.00 | 0.000 | B | 20% | 94.3% |
| 4-3 | 8.00% | 1:3 | 1.10 | 0.088 | B | 20% | 94.3% |
| 4-1 | 8.00% | 1:1 | 1.10 | 0.088 | B | 20% | 94.3% |
| 4-2 | 8.00% | 3:1 | 1.10 | 0.088 | B | 20% | 96.0% |
| 4-3 | 8.00% | 1:3 | 1.10 | 0.088 | B | 84% | 95.4% |
| 4-1 | 8.00% | 1:1 | 1.10 | 0.088 | B | 84% | 96.6% |
| 4-2 | 8.00% | 3:1 | 1.10 | 0.088 | B | 84% | 100.0% |
| 4-3 | 8.00% | 1:3 | 1.10 | 0.088 | C | 32% | 89.8% |
| Control | 0.00% | — | 0.00 | 0.000 | C | 32% | 90.6% |
| 4-1 | 8.00% | 1:1 | 1.10 | 0.088 | C | 32% | 90.6% |
| 4-2 | 8.00% | 3:1 | 1.10 | 0.088 | C | 32% | 91.1% |

TABLE V

| Sample ID | Coverage (g/sq2. m.) | Printer ID | Relative Humidity | Print Length | Haze (percent) |
|---|---|---|---|---|---|
| 1-1 | 0.225 Rice Starch | B | 84% | 100% | 34.1 |
| 1-2 | 0.169 Rice Starch | B | 84% | 100% | 29.7 |
| 1-5 | 0.250 Rice Starch | B | 84% | 100% | 32.0 |
| 2-3 | 0.281 $ZrO_2$ | B | 84% | 100% | 31.2 |
| 2-5 | 0.250 $ZrO_2$ | B | 84% | 100% | 28.7 |
| 3-2 | 0.088 3:1 $TiO_2$:$ZrO_2$ | B | 84% | 100% | 41.4 |
| 4-2 | 0.088 3:1 $TiO_2$:ZnO | B | 84% | 100% | 56.6 |
| 5-1 | 0.088 $TiO_2$ | B | 20% | 100% | 43.9 |
| 5-2 | 0.088 $TiO_2$ | C | 32% | 91% | 45.0 |
| 5-3 | 0.088 $TiO_2$ | A | 31% | 95% | 45.8 |
| 5-4 | 0.088 $TiO_2$ | B | 84% | 100% | 46.5 |
| 5-5 | 0.120 $TiO_2$ | B | 20% | 100% | 51.2 |
| 5-6 | 0.120 $TiO_2$ | C | 32% | 100% | 52.1 |
| 5-7 | 0.120 $TiO_2$ | A | 31% | 100% | 51.9 |
| 5-8 | 0.120 $TiO_2$ | B | 84% | 100% | 52.0 |

TABLE VI

| Sample ID | Coverage (g/sq2. m.) | Layer with $ZrO_2$ | Relative Humidity | Print Length | Haze (percent) |
|---|---|---|---|---|---|
| 6-1 | 0 $ZrO_2$ | none | 86% | 97% | 23.4 |
| 6-2 | 0 $ZrO_2$ | none | 86% | 92% | 25.6 |
| 6-3 | 0.980 $ZrO_2$ | Receptor | 86% | 97% | 31.2 |
| 6-4 | 1.898 $ZrO_2$ | Receptor | 86% | 100% | 36.1 |
| 6-5 | 0.403 $ZrO_2$ | Under-layer | 86% | 97% | 49.1 |
| 6-6 | 0.735 $ZrO_2$ | Under-Layer | 86% | 100% | 58.4 |

TABLE VII

| Sample ID | Coverage (g/sq2. m.) | Layer with Rice Starch | Relative Humidity | Print Length | Haze (percent) |
|---|---|---|---|---|---|
| 7-1 | 0 Rice Starch | none | 85% | 98% | 24.4 |
| 7-2 | 0 Rice Starch | none | 85% | 97% | 26.1 |
| 7-3 | 0.525 Rice Starch | Under-layer | 85% | 100% | 50.5 |
| 7-4 | 0.548 Rice Starch | Under-layer | 85% | 97% | 51.0 |

TABLE VII-continued

| Sample ID | Coverage (g/sq2. m.) | Layer with Rice Starch | Relative Humidity | Print Length | Haze (percent) |
|---|---|---|---|---|---|
| 7-5 | 0.682 Rice Starch | Under-layer | 85% | 100% | 55.5 |
| 7-6 | 0.712 Rice Starch | Under-layer | 85% | 100% | 56.9 |
| 7-7 | 0.850 Rice Starch | Under-layer | 85% | 100% | 60.4 |

What is claimed:

1. A transparent ink-jet recording film comprising:

a transparent substrate comprising a polyester, said substrate comprising at least a first surface and a second surface;

at least one under-layer disposed on said first surface;

at least one image-receiving layer disposed on said at least one under-layer, said at least one image-receiving layer comprising at least one inorganic particle and at least one water soluble or water dispersible polymer comprising at least one hydroxyl group; and at least one back-coat layer disposed on said second surface, said at least one back-coat layer comprising gelatin, wherein at least one of said at least one under-layer, said at least one image-receiving layer, or said at least one back-coat layer further comprises at least one reflective particle comprising rice starch.

2. The transparent ink jet recording film according to claim 1, wherein the at least one back-coat layer comprises the at least one reflective particle.

3. The transparent ink-jet recording film according to claim 1, wherein the at least one inorganic particle comprises boehmite alumina and the at least one water soluble or water dispersible polymer comprises poly(vinyl alcohol).

4. The transparent ink-jet recording film according to claim 1, wherein the at least one under-layer comprises gelatin and a borate or borate derivative.

5. The transparent ink-jet recording film according to claim 1 exhibiting a haze value less than about 41%.

6. The transparent ink-jet recording film according to claim 5, wherein the at least one back-coat layer comprises the at least one reflective particle.

7. The transparent ink-jet recording film according to claim 6, wherein the at least one reflective particle comprises rice starch.

* * * * *